US006630102B2

(12) United States Patent
Wilmes

(10) Patent No.: US 6,630,102 B2
(45) Date of Patent: Oct. 7, 2003

(54) MATERIAL PRODUCED USING POWDER METALLURGY WITH IMPROVED MECHANICAL PROPERTIES

(75) Inventor: Siegfried Wilmes, Meerbusch (DE)

(73) Assignee: Böhler-Uddeholm Aktiengesellschaft, Vienna (AT)

( * ) Notice: Subject to any disclaimer, the term of this patent is extended or adjusted under 35 U.S.C. 154(b) by 0 days.

(21) Appl. No.: 09/796,452

(22) Filed: Mar. 2, 2001

(65) Prior Publication Data

US 2001/0022945 A1 Sep. 20, 2001

(30) Foreign Application Priority Data

Mar. 3, 2000 (AT) ..... 349/2000

(51) Int. Cl.[7] ..... B22F 3/17
(52) U.S. Cl. ..... 419/28; 75/228; 419/29; 419/38; 419/49
(58) Field of Search ..... 419/28, 29, 49, 419/38; 75/228

(56) References Cited

U.S. PATENT DOCUMENTS 3,966,422 A * 6/1976 Kelley
4,121,927 A * 10/1978 Lohman et al. ..... 419/14
4,479,833 A * 10/1984 Gessinger et al. ..... 148/514
4,569,823 A * 2/1986 Westin ..... 419/23
5,201,966 A * 4/1993 Hirai ..... 148/514
5,989,490 A 11/1999 Pinnow et al. ..... 419/11

FOREIGN PATENT DOCUMENTS

| | | | |
|---|---|---|---|
| DE | 3530741 | | 12/1986 |
| DE | 3726447 | | 2/1988 |
| DE | 279428 | | 6/1990 |
| EP | 0433264 | | 6/1991 |
| GB | 2181745 A | * | 4/1987 |

OTHER PUBLICATIONS

Wilmes, "Pulvermetalllurgische Werkzeugstahle—Herstellung, Eigenschaften und Anwendung", *Stahl und Eisen*, Verlag Stahleisen GmbH, Dusseldorf, vol. 110, No. 1, pp. 93–103, XP000103109, ISSN: 0340–4803 (Jan. 15, 1990).

* cited by examiner

*Primary Examiner*—Ngoclan Mai
(74) *Attorney, Agent, or Firm*—Greenblum & Bernstein, P.L.C.

(57) ABSTRACT

The invention relates to a process for the powder metallurgical production of material having improved isotropy of its mechanical properties with a rectangular or flat elliptical cross section, so-called broad-flat material, in particular raw material for producing cutting or piercing tools, in which process a powder of an alloy produced with gas, in particular pulverized with nitrogen, is placed into a capsule, compressed, and the capsule is closed, optionally after an evacuation, whereupon a heating and isostatic pressing (HIPing) of the powder capsules occur and the hot isostatically pressed slug produced in this manner is subjected to a forming by forging.

48 Claims, 3 Drawing Sheets

MATERIAL PRODUCED USING POWDER METALLURGY WITH IMPROVED MECHANICAL PROPERTIES

CROSS-REFERENCE TO RELATED APPLICATIONS

The present application claims priority under 35 U.S.C. §119 of Austrian Patent Application No. 349/2000, filed on Mar. 3, 2000, the disclosure of which is expressly incorporated by reference herein in its entirety.

BACKGROUND OF THE INVENTION

1. Field of the Invention

The invention relates to a process for the powder metallurgical production of material having improved isotropy with a rectangular or flat elliptical cross section, so-called broad-flat material, in particular raw material for producing cutting or piercing tools, in which a powder of an alloy produced using gas, in particular pulverized using nitrogen, is placed in a capsule, compressed, and optionally sealed, after which a heating and isostatic pressing (HIP-ing) of the powder capsules occur and the hot-isostatically pressed slug is subjected to a forming by forging and/or rolling.

The invention further includes a material produced using powder metallurgy with a rectangular or flat elliptical cross section, so-called broad-flat material, with a width that is at least about 3.1 times the height and a degree of deformation of at least two times, in particular produced according to one of the processes named above.

2. Discussion of Background Information

In the solidification of alloys, demixing often occur that are impossible to compensate for or dissolve using diffusion in the case of ledeburite steels. Here, the size of the phases and/or grains deposited from the melt depends on the formation and/or setting time.

In conventional ledeburite tool steels produced by ingot casting, for example, coarse primary carbides and a carbide network may be present in the casting state. If these castings or blocks are subjected to a hot forming, the mechanical material properties are indeed improved, but the degree of improvement depends upon the stressing direction. Here, it is entirely possible for the results of a flexural impact test crosswise to the forming direction to amount to merely about 25 to 30% of the flexural impact values in comparison to those measured in the forming direction. This direction dependence of the material toughness can be explained by a distinctive carbide cell structure in conventionally produced material, which is also microscopically verifiable.

In order to achieve extensively isotropic mechanical material properties, processes were developed for the powder metallurgical production of work pieces. In this process, a separation of a fluid stream of metal into droplets occurs, in particular using gas streams with a high speed and energy, after which the droplets solidify in a short time. In the individual powder grains with a diameter, as a rule, of less than about 0.3 mm, the structural phases are homogeneously distributed and very fine because of the extremely short hardening time. The powder produced in that manner is then placed into a capsule, which is then closed and subsequently subjected to high temperature and high pressure from all sides, whereupon the powder grains connect metallically and/or the powder welds together or sinters. This process is called hot isostatic pressing (HIP-ing).

Such a material produced using powder metallurgy (PM material) can be used in an unformed state or be formed to improve its mechanical properties.

In the case of parts made of carbide-rich working steels, a fine homogenous microstructure is expected from the PM production, which is confirmed by structure images that show almost completely evenly distributed carbides of a uniformly small size and, due to this structure, no significant directional dependency of the mechanical properties in the formed material. While the differences in toughness in this working material in the direction of deformation and perpendicular to it have been reported, these differences amount to about 8 to 20% at the most and, up to now, have essentially been attributed to the not entirely preventable content of non-metal inclusions and a so-called fiber structure.

In practical use, cutting and piercing tools produced using powder metallurgy such as die plates, upper dies, and the like with a rectangular flat cross section form exhibited partially only a short lifespan; completely unexpected cases of damage occurred due to the breaking of tools. Extensive investigation of the mechanical properties, in particular the main stressing corresponding to the impact toughness of the material, was performed on so-called broad-flat bars. Samples were taken from the bar in the lengthwise, crosswise, and depth directions and each directionally oriented sample was tested with break-inducing impacts displaced from one another by 90°. The designation and position of the samples can be found in the table below and in FIG. 1. They mean:

L-S Sample in the longitudinal direction, impact on the flat side in the direction of the depth L-T Sample in the longitudinal direction, impact on the narrow side in the direction of the width T-L Sample in the direction of the width, impact on the face side in the longitudinal direction T-S Sample in the direction of the width, impact on the flat side in the direction of the thickness S-L Sample in the direction of the thickness, impact on the face side in the longitudinal direction S-T Sample in the direction of the thickness, impact on the narrow side in the direction of the width Tests on broad-flat material (about 380×55 mm) made of high-speed steel (HS 6-5-3) had the following approximate results in % as compared to the impact strength in the L-S test.

L-S 100%
L-T 100%
T-S 80%
T-L 80%
S-T 25%
S-L 25%

The extremely low bending strength of powder metallurgically produced broad-flat material in the direction of the depth was completely unexpected and unknown in professional circles, but did explain the tool breakages mentioned above. In scientific experiments, a so-called fiber model was developed, whose effectiveness is derived from bonding faults and demixings on the boundary surface of the pulverized and formed particles. However, this is opposed by an absolute uniformity and purity of the raw material from the pulverization and HIP process, which does not lead to expectations of a fiber structure and, in the matrix for showing the carbide arrangement and carbide size, which is normally etched darkly, does not allow recognition of such a structure.

In further microscopic tests, structural regions were found with various etchings in comparison to the remaining regions of the material, which supported the fiber theory. However, a structure with coarse grains adapted to the forming process was not metallographically verifiable.

SUMMARY OF THE INVENTION

The present invention provides a process of the type mentioned at the outset by which an improved isotropy of the mechanical properties, in particular an increase in the impact strength and flexural breaking strength in the depth direction of broad-flat material of formed PM working pieces. Further, the present invention is directed to a material produced using powder metallurgy with a rectangular or flat elliptical cross section, i.e., a so-called broad-flat material with a width that is at least about 3.1 times the thickness and a degree of deformation of at least about 4 times.

The present invention includes a slug with such a rectangular or flat elliptical cross sectional shape is prepared and subjected to a shaping in such a way that the difference between the forming in the direction of the width and the forming in the direction of the depth of the cross section of the broad-flat material is at most two times, preferably about 1.5 times, the lower deformation value.

Moreover, when the hot isostatically pressed slug is subjected to a compressive shaping with a degree of compression of at least twofold, whereafter a stretch shaping of the compressed slug occurs while forming the broad-flat material.

Another aspect of the invention is for the hot isostatically pressed slug to be subjected to a diffusion annealing treatment with a maximum temperature of about 20° below the solidus temperature of the alloy and a minimum annealing duration of about 4 hours, whereafter it is forged and/or rolled into a broad-flat material by a stretch forming.

The advantage of the process according to the invention can particularly be seen in the fact that the effectiveness of the regions of the material negatively influencing the strength properties are reduced. The formation of these regions has not yet been scientifically explained and the reason for these zones in the material negatively influencing the mechanical properties cannot yet be construed with certainty because a somewhat finer globulite carbide structure is present in the regions or zones that are etched more darkly in a cutting test.

If, however, as is provided according to the invention, the slug is produced with a cross sectional form which, in the subsequent shaping, requires a difference in the degrees of deformation of a maximum of twofold, small deviations in the mechanical properties are present in these directions and substantially higher flexural impact work values are achieved than those that are present in a hot isostatically pressed, unformed work piece.

If, according to the invention, the hot isostatically pressed slug is subjected to a compressive shaping at a forging temperature, whereupon a so-called stretching or stretch forging of the compressed forged piece occurs, in which a broad-flat profile is produced; thus, as was found, the values for the flexural impact work of the material in the crosswise and depth directions of the profiles are essentially the same level and lie at approximately 80% of the values present in the longitudinal direction of the material.

If, as provided according to a further embodiment of the invention, the hot isostatically pressed slug or a forged slug that has been slightly shaped is subjected to a diffusion annealing, whereupon the end forming occurs; thus, according to the invention, high strength values of the material are achieved in the depth direction as well, in particular in a broad-flat material.

The processes according to the invention solve the problem of a significant anisotropy in broad-flat materials produced using powder metallurgy, in particular in ledeburite steels of this cross sectional form, and they generally increase the stressability of products produced in this manner.

A further aspect of the invention is attained in that the strength of the material, measured in any direction, in particular in the direction of the depth of the cross section of the material, is greater than that of the material in its hot isostatically pressed, unformed state.

The advantage of material produced in this manner is essentially supported by the fact that tools made from this material are less notch sensitive and thus can sustain substantially greater stresses and impact-like loads. Thus, for example, warm pressing die plates were produced from the face side of a broad-flat material produced in a conventional manner and a broad-flat material produced according to the invention and tested in practical use. The service life of the tool made of conventional material was extremely short; after 33 impact-like pressings, a protruding part of the profile broke off, though no other wear or abrasion could be detected. The die plate produced in the same manner for the same purpose made of broad-flat material produced using similar material forming in the width and depth directions generated over 3000 pressings, after which the tool was retired due to abrasive wear.

The invention provides for a process of making a powder metal material comprising placing a powder of an alloy into a capsule, compressing the capsule, forming a slug from the capsule, subjecting the slug to one of forming by forging and rolling, and shaping the slug to form a cross section shape having a width and a depth, wherein during the shaping, a difference between deformation in a direction of the width and a deformation in a direction of the depth is a maximum of 2 times a lower deformation value.

The material may have improved isotropy of its mechanical properties. The material may comprise one of a rectangular, a flat, and an elliptical cross section. The material may comprise a broad-flat material. The material may be used to make a tool. The tool may be one of a cutting, a piercing, and a shaping tool. The powder may be of an alloy with gas. The alloy may be pulverized with nitrogen. Before the heating, the process may comprise evacuating the capsule and thereafter closing the capsule. The slug may be shaped to have one of a rectangular, a flat, and an elliptical cross sectional shape. The difference between the deformation in the direction of the width and the deformation in the direction of the depth is a maximum of 1.5 times the lower deformation value. The forming may comprise heating and isostatic pressing the capsule to form a hot isostatically pressed slug. The width of the cross sectional shape may be at least 3.1 times the depth. The cross sectional shape may have a degree of deformation of at least 4 times. The cross sectional shape may comprise a strength measured in any direction which is greater than that of the material in its hot isostatically pressed unformed state. The strength may be measured in the direction of the depth of the cross sectional shape.

The invention also provides for a process of making a powder metal material comprising placing a powder of an alloy into a capsule, compressing the capsule, forming a slug from the capsule, subjecting the slug to one of forming by forging and rolling, compressive shaping the slug in a longitudinal direction with a degree of compression which is at least twofold, and stretch shaping of the slug to form a broad-flat material.

The material may have improved isotropy of its mechanical properties. The material may comprise one of a rectangular, a flat, and an elliptical cross section. The material may comprise a broad-flat material. The material may be used to make a tool. The tool may be one of a cutting, a piercing, and a shaping tool. The powder may be of an alloy with gas. The alloy may be pulverized with nitrogen. Before the heating, the process may comprise evacuating the capsule and thereafter closing the capsule. The slug may be shaped to have one of a rectangular, a flat, and an elliptical cross sectional shape. The forming may comprise heating and isostatic pressing the capsule to form a hot isostatically pressed slug. The width of the cross sectional shape may be at least 3.1 times the depth. The cross sectional shape may have a degree of deformation of at least 4 times. The cross sectional shape may comprise a strength measured in any direction which is greater than that of the material in its hot isostatically pressed unformed state. The strength may be measured in the direction of the depth of the cross sectional shape.

According to another aspect of the invention, there is provided a process of making a powder metal material comprising placing a powder of an alloy into a capsule, compressing the capsule, forming a slug from the capsule, subjecting the slug to one of forming by forging and rolling, diffusion annealing the slug with a maximum temperature of 20° C. below a solidus temperature of the alloy and with a minimum duration of 4 hours, and stretch shaping the slug to form a broad-flat material via one of forging and rolling.

The material may have improved isotropy of its mechanical properties. The material may comprise one of a rectangular, a flat, and an elliptical cross section. The material may comprise a broad-flat material. The material may be used to make a tool. The tool may be one of a cutting, a piercing, and a shaping tool. The powder may be of an alloy with gas. The alloy may be pulverized with nitrogen. Before the heating, the process may comprise evacuating the capsule and thereafter closing the capsule. The slug may be shaped to have one of a rectangular, a flat, and an elliptical cross sectional shape. The forming may comprise heating and isostatic pressing the capsule to form a hot isostatically pressed slug. The width of the cross sectional shape may be at least 3.1 times the depth. The cross sectional shape may have a degree of deformation of at least 4 times. The cross sectional shape may comprise a strength measured in any direction which is greater than that of the material in its hot isostatically pressed unformed state. The strength may be measured in the direction of the depth of the cross sectional shape.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention shall be described in the following with reference to examples from material tests.

In accordance with the gas atomization process with nitrogen, a powder with an average grain size of about 0.09 mm was produced from a melt with a composition in approximate percent by weight of C=1.3, Si 0.63, Mn=0.24, S=0.013, P=0.019, Cr=3.83, O=4.87, W=6.11, V=3.03 Co=0.40, Cu=0.013, Sn=0.011.

Raw material with the form about 550 mm square and about 800×220 mm was produced according to the HIP process, whereupon, on the one hand, a direct forming of a quadratic and rectangular material into a rod cross section of about 550×100 mm. Another quadratic raw material was annealed before forming for about 43 hours at a temperature of about 38° C. below the solidus temperature of the alloy determined under a heating stage microscope. Finally, a compression to about 48% of its original height was performed on a hot isostatically pressed slug before deformation on the cross sectional format about 550×100 mm. For comparison purposes, a hot isostatically pressed unformed material is provided.

Figure 1:
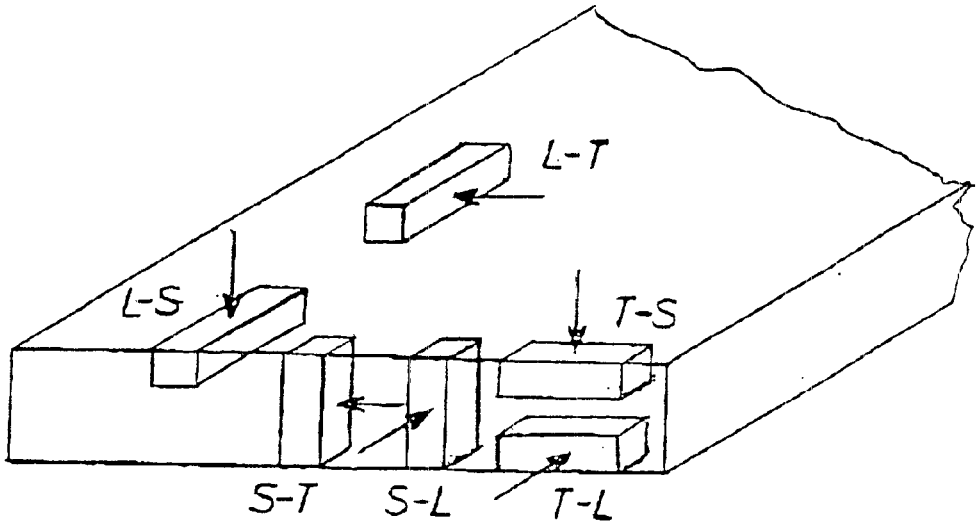
FIG. 1 illustrates samples which were taken from a bar in lengthwise, crosswise, and depth directions for testing.
Figure 2:
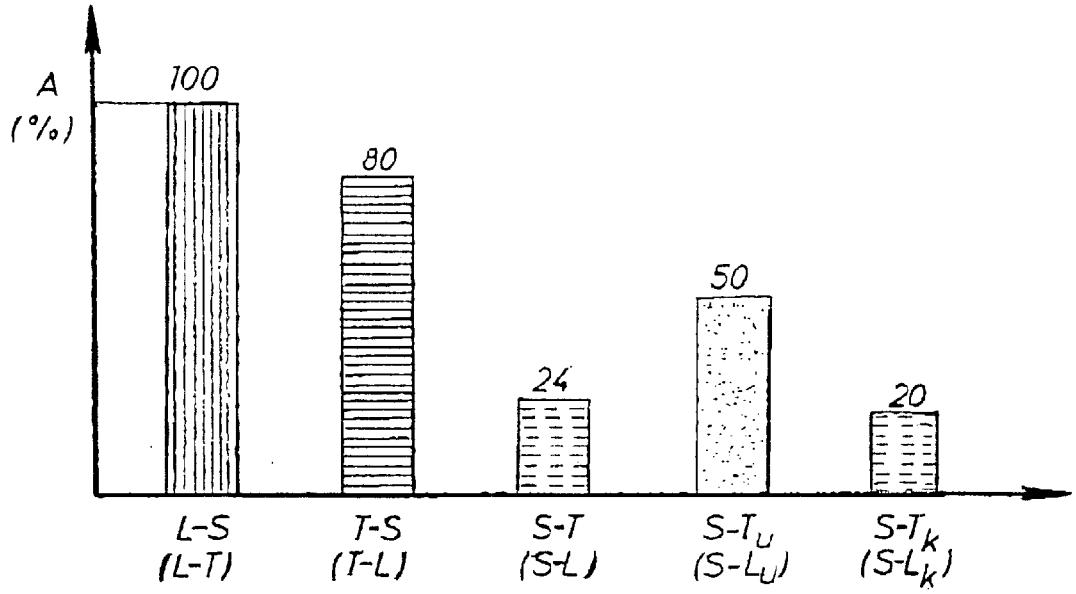
FIG. 2 relates to a broad-flat material produced from a block of about 550 mm.
Figure 3:
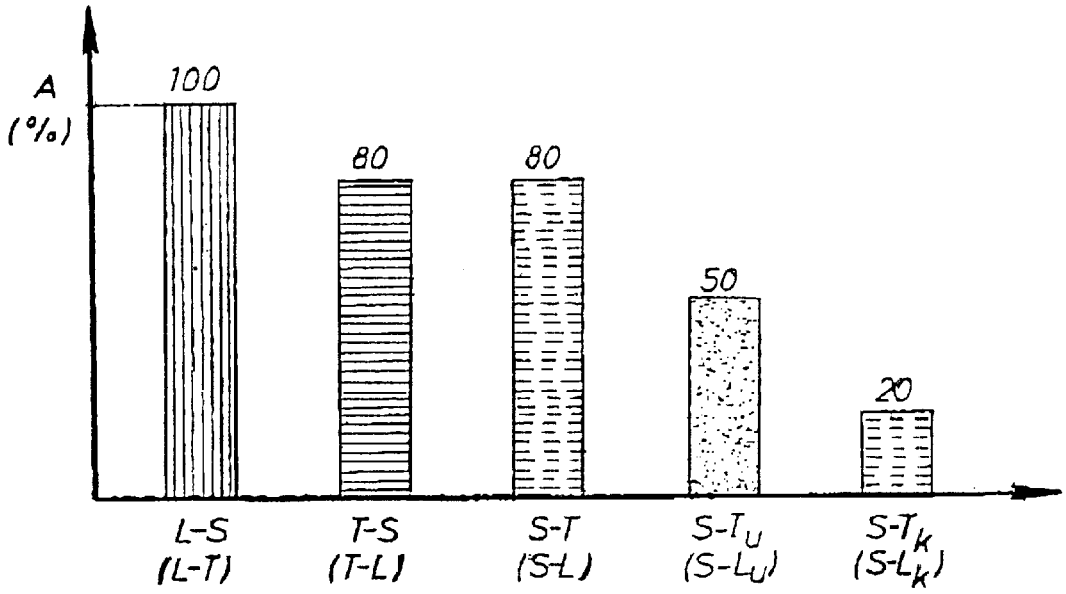
FIG. 3 relates to Material A, produced in accordance with the exemplary process of the instant invention.
Figure 4:
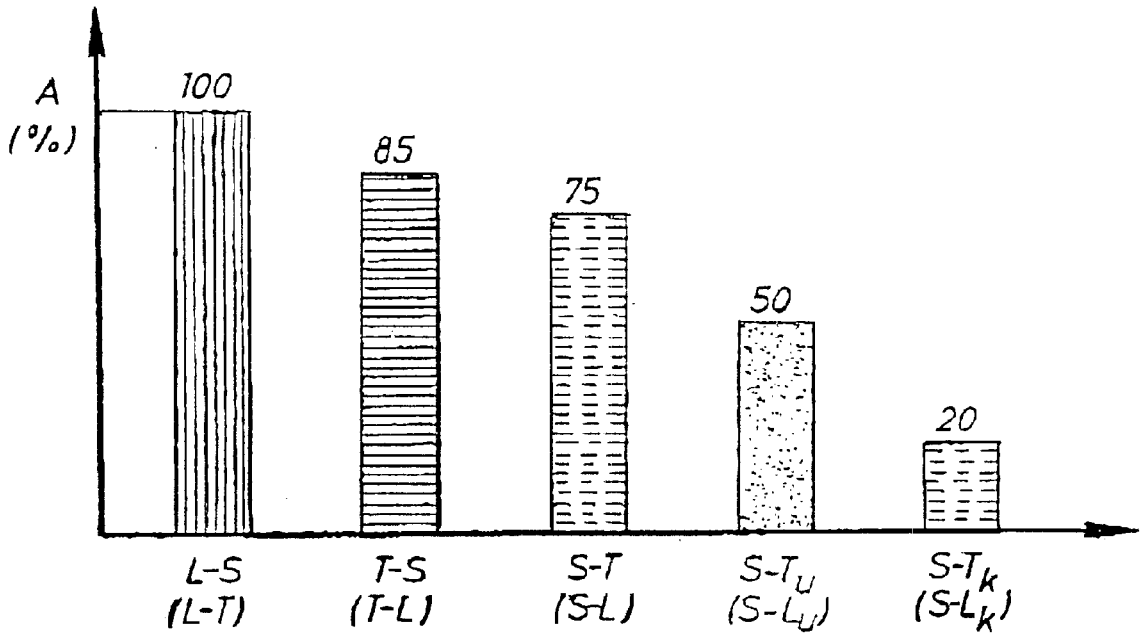
FIG. 4 relates to Material B, produced in accordance with an alternative exemplary process of the instant invention.
Figure 5:
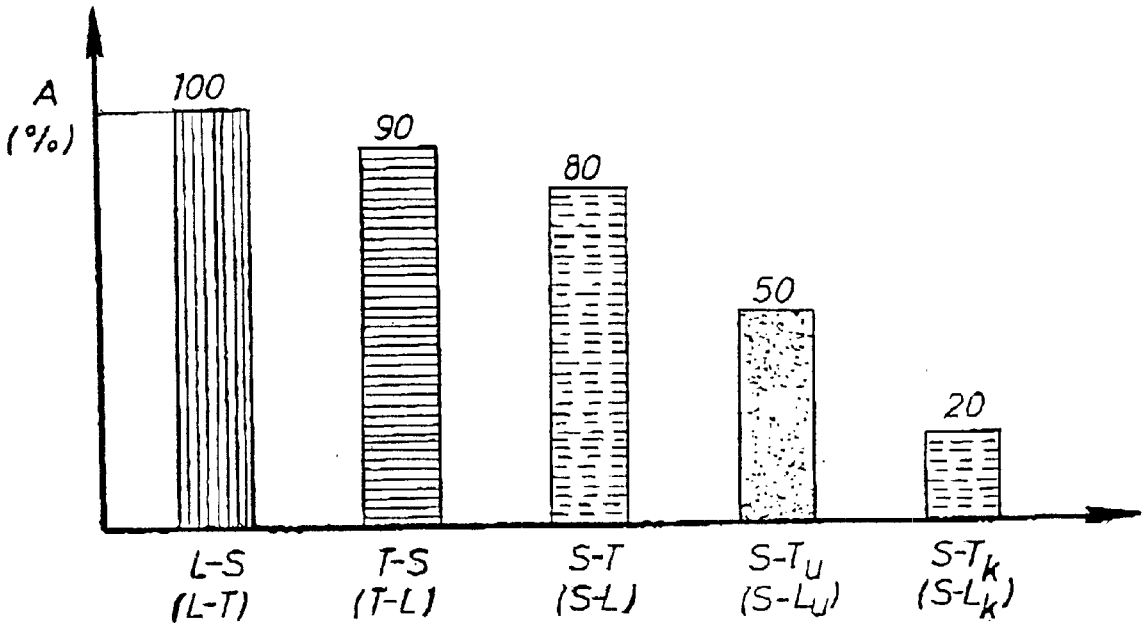
FIG. 5 relates to Material C, produced in accordance with another alternative exemplary process of the instant invention.

Samples were taken from all broad-flat materials produced in this manner in accordance with the position shown in FIG. 1 and hardened to a hardness of about 55 to 63 HRC. As is common for hard tools, unnotched impact tests with the masses about 7×10×55 mm were used. In the identification, the first letter indicates the position of the sample in the material. The second letter indicates the direction of impact, shown by an arrow. The test of the notched impact working values of the materials provided the results shown in FIGS. 2 to 5, with the test values in the longitudinal direction being indicated as about 100%.

The test values T-S and T-L as well as S-T and S-L lay in the same range of dispersion throughout, so only one size and/or value is accounted for in FIGS. 2 to 5.

Furthermore, in the depictions, S-$T_U$ means the strength of the HIPed, unformed sample in the direction of the depth and S-$T_K$ means the strength of a conventionally produced broad-flat material in the direction of the depth.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process of making a powder metal material comprising:

placing a powder of an alloy into a capsule;

compressing the capsule;

forming a slug from the capsule;

subjecting the slug to one of forming by forging and rolling; and shaping the slug to form a cross section shape having a width and a depth, wherein during the shaping, a difference between a deformation in a direction of the width and a deformation in a direction of the depth is a maximum of 2 times a lower value of the deformation in the width direction and of the deformation in the depth direction.

2. The process of claim 1 wherein the powder metal material has improved isotropy of its mechanical properties.

3. The process of claim 1, wherein the powder metal material comprises one of a rectangular, a flat, and an elliptical cross section.

4. The process of claim 1, wherein the powder metal comprises a broad-flat material.

5. The process of claim 1, wherein the powder metal material is used for making a tool.

6. The process of claim 5, wherein the tool is one of a cuffing, a piercing, and a shaping tool.

7. The process of claim 1, wherein the powder may comprise the alloy produced with a gas.

8. The process of claim 7, wherein the alloy is pulverized with nitrogen.

9. The process of claim 1, wherein the process further comprises:

evacuating the capsule an thereafter closing the capsule; and heating the capsule.

10. The process of claim 1, wherein the difference between the deformation in the direction of the width and the deformation in the direction of the depth is a maximum of 1.5 times the lower value of the deformation in the width direction and of the deformation in the depth direction.

11. The process of claim 1, wherein the forming comprises heating and isostatic pressing the capsule to form a hot isostatically pressed slug.

12. The process of claim 1, wherein the width of the cross sectional shape is at least 3.1 times the depth.

13. The process of claim 12, wherein the cross sectional shape has a degree of deformation of at least 4 times.

14. The process of claim 1, wherein the cross sectional shape comprises a strength measured in any direction which is greater than that of the material in its hot isostatically pressed unformed state.

15. The process of claim 14, wherein the strength is measured in the direction of the depth of the cross sectional shape.

16. A process of making a powder metal material comprising:

placing a powder of an alloy into a capsule;

compressing the capsule;

forming a slug from the capsule;

subjecting the slug to one of forming by forging and rolling;

compressively shaping the slug in a longitudinal direction with a degree of compression which is at least twofold;

stretch shaping of the slug to form a broad-flat material.

17. The process of claim 16, wherein the powder metal material has improved isotropy of its mechanical properties.

18. The process of claim 16, wherein the powder metal material comprises one of a rectangular, a flat, and an elliptical cross section.

19. The process of claim 16, wherein the powder metal material is used for making a tool.

20. The process of claim 19, wherein the tool is one of a cuffing, a piercing, and a shaping tool.

21. The process of claim 16, wherein the powder may comprise the alloy produced with a gas.

22. The process of claim 21, wherein the alloy is pulverized with nitrogen.

23. The process of claim 16, wherein the process further comprises:

evacuating the capsule and thereafter closing the capsule; and heating the capsule.

24. The process of claim 16, wherein the forming comprises heating and isostatic pressing the capsule to form a hot isostatically pressed slug.

25. The process of claim 16, wherein a width of a cross sectional shape of the broad-flat material is at least 3.1 times a depth.

26. The process of claim 25, wherein the cross sectional shape has a degree of deformation of at least 4 times.

27. The process of claim 16, wherein a cross sectional shape of the broad-flat material comprises a strength measured in any direction which is greater than that of the material in its hot isostatically pressed unformed state.

28. The process of claim 27, wherein the strength is measured in the direction of the depth of the cross sectional shape.

29. A process of making powder metal material comprising:

placing a powder of an alloy into a capsule;

compressing the capsule;

forming a slug from the capsule;

subjecting the slug to one of forming by forging and rolling;

diffusion annealing the slug with a maximum temperature of 20° C. below a solidus temperature of the alloy and with a minimum duration of 4 hours; and stretch shaping the slug to form a broad-flat material via one of forging and rolling.

30. The process of claim 29, wherein the powder metal material has improved isotropy of its mechanical properties.

31. The process of claim 29, wherein the powder metal material comprises one of a rectangular, a flat, and an elliptical cross section.

32. The process of claim 29, wherein the powder metal material is used for making a tool.

33. The process of claim 32, wherein the tool is one of a cutting, a piercing, and a shaping tool.

34. The process of claim 29, wherein the powder may comprise the alloy produced with a gas.

35. The process of claim 34, wherein the alloy is pulverized with nitrogen.

36. The process of claim 29, wherein the process further comprises:

evacuating the capsule and thereafter closing the capsule; and heating the capsule.

37. The process of claim 29, wherein the forming comprises heating and isostatic pressing the capsule to form a hot isostatically pressed slug.

38. The process of claim 29, wherein a width of a cross sectional shape of the broad-flat material is at least 3.1 times a depth.

39. The process of claim 38, wherein the cross sectional shape has a degree of deformation of at least 4 times.

40. The process of claim 29, wherein a cross sectional shape of the broad-flat material comprises a strength measured in any direction which is greater than that of the material in its hot isostatically pressed unformed state.

41. The process of claim 40, wherein the strength is measured in the direction of the depth of the cross sectional shape.

42. A powder metal material formed according to the process of claim 1.

43. A powder metal material formed according to the process of claim 16.

44. A powder metal material formed according to the process of claim 29.

45. A powder metal material comprising:

a broad flat material having a width at least 3.1 times greater than a thickness and having a degree of deformation fat least 4 times, wherein a formation of said broad flat material includes hot isostatic pressing of a material in an unformed state, and a strength of the broad flat material is greater than a strength of the material in the hot isostatically pressed, unformed state.

46. The powder metal material in accordance with claim 45, wherein said broad flat material comprises one of a rectangular and flat elliptical cross-section.

47. The powder metal material in accordance with claim 45, wherein the strength is measured in any direction.

48. The powder metal material in accordance with claim 45, wherein the strength is measured in a direction of the thickness.

* * * * *

UNITED STATES PATENT AND TRADEMARK OFFICE

CERTIFICATE OF CORRECTION

PATENT NO. : 6,630,102 B2
DATED : October 7, 2003
INVENTOR(S) : Wilmes

It is certified that error appears in the above-identified patent and that said Letters Patent is hereby corrected as shown below:

Title page,
Item [*] Notice, delete "by 0" and insert -- by 49 days --.

Signed and Sealed this

Seventh Day of March, 2006

JON W. DUDAS
*Director of the United States Patent and Trademark Office*